United States Patent [19]

Robinette

[11] 4,189,136

[45] Feb. 19, 1980

[54] AUTOMATIC BAG TUBE FEEDER

[75] Inventor: James A. Robinette, Bristol, Tenn.

[73] Assignee: Strong-Robinette Bag Company, Inc., Bristol, Tenn.

[21] Appl. No.: 821,391

[22] Filed: Aug. 1, 1977

[51] Int. Cl.[2] ..... B65H 3/08; B65H 1/16

[52] U.S. Cl. ..... 271/12; 271/30 R; 271/91; 271/155; 271/157; 414/121

[58] Field of Search ..... 271/11, 12, 13, 14, 271/15, 30 R, 31, 147, 157, 162, 152, 153, 154, 155, 156, 127, 107, 108, 91, 20, 104, 106; 214/8.5 A, 8.5 D; 414/118, 121

[56] References Cited

U.S. PATENT DOCUMENTS

| | | | |
|---|---|---|---|
| 1,070,021 | 8/1913 | Dreher | 214/8.5 D |
| 2,011,464 | 8/1935 | Winkler et al. | 271/101 X |
| 2,140,719 | 12/1938 | Rohrbacher | 271/30 R |
| 3,322,301 | 5/1967 | Bliss | 271/20 X |
| 3,391,924 | 7/1968 | Schmidlin et al. | 271/11 X |
| 3,887,178 | 6/1975 | Fujimoto | 271/30 R |

FOREIGN PATENT DOCUMENTS

| | | | |
|---|---|---|---|
| 1212768 | 11/1970 | United Kingdom | 271/107 |

*Primary Examiner*—Bruce H. Stoner, Jr.
*Attorney, Agent, or Firm*—Mason, Fenwick & Lawrence

[57] ABSTRACT

A bag tube feeder has an intermittently operated conveyor supporting a row of aligned stacks of bag tubes with a plurality of movable suction cups positioned over an outfeed station in which a stack of bag tubes is positioned. A pair of pneumatic cylinders lowers the suction cups to engage the uppermost bag tube, then lift the bag tube and a pneumatic cylinder swings the bag tube into the nip of a roller and an outfeed conveyor belt which takes the bag tube to a discharge location. A photo-electric sensor senses lowering of the stack of bag tubes in the outfeed station to automatically actuate a pneumatic cylinder arrangement for lifting the discharge end of the conveyor to maintain the top of the stack in a desired position. A mechanical sensor senses the depletion of the stack in the outfeed station to initiate actuation of the stack infeed conveyor to move the next adjacent stack into the outfeed station automatically.

22 Claims, 20 Drawing Figures

290
293
294
291
218
217
292
138
106
116
134
R
S3
S2
S1
G
130
146
68
196
132
75
156'
158
74
155'
155
147
150
61
62
154
142
140
156
64
162
102
168
170
172
180
184
192
186
233
204
202
216
236
224
T
10

11
13
13
11
236
218
237
227
224
232
234
230
202
196
207
217
216
292
228
225
233
242
222
233
227
224
218
220
233
240
226
223
206
204
214
215
198
288
205
200
208
211
88
258
68
61
138
153
150
140
146
154
158
64
51
140
148
256
130
66
152
136
58

Fig-15
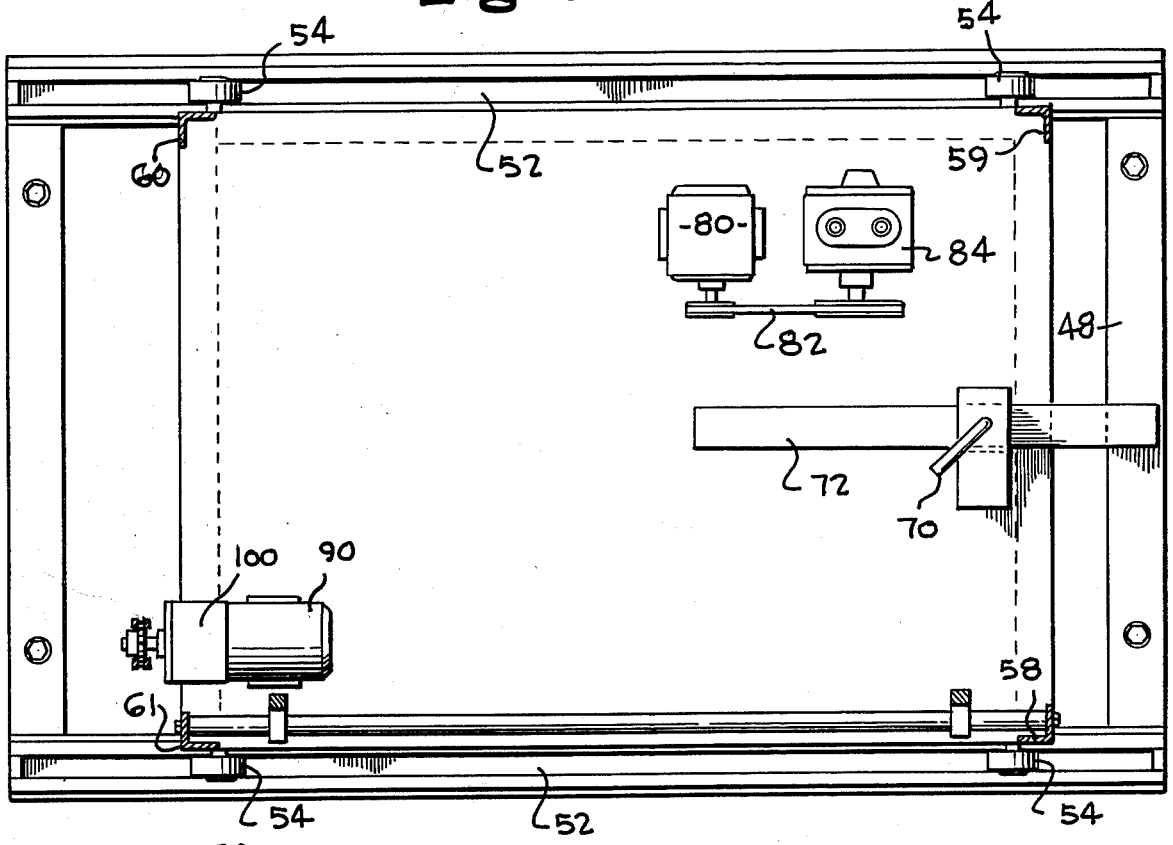
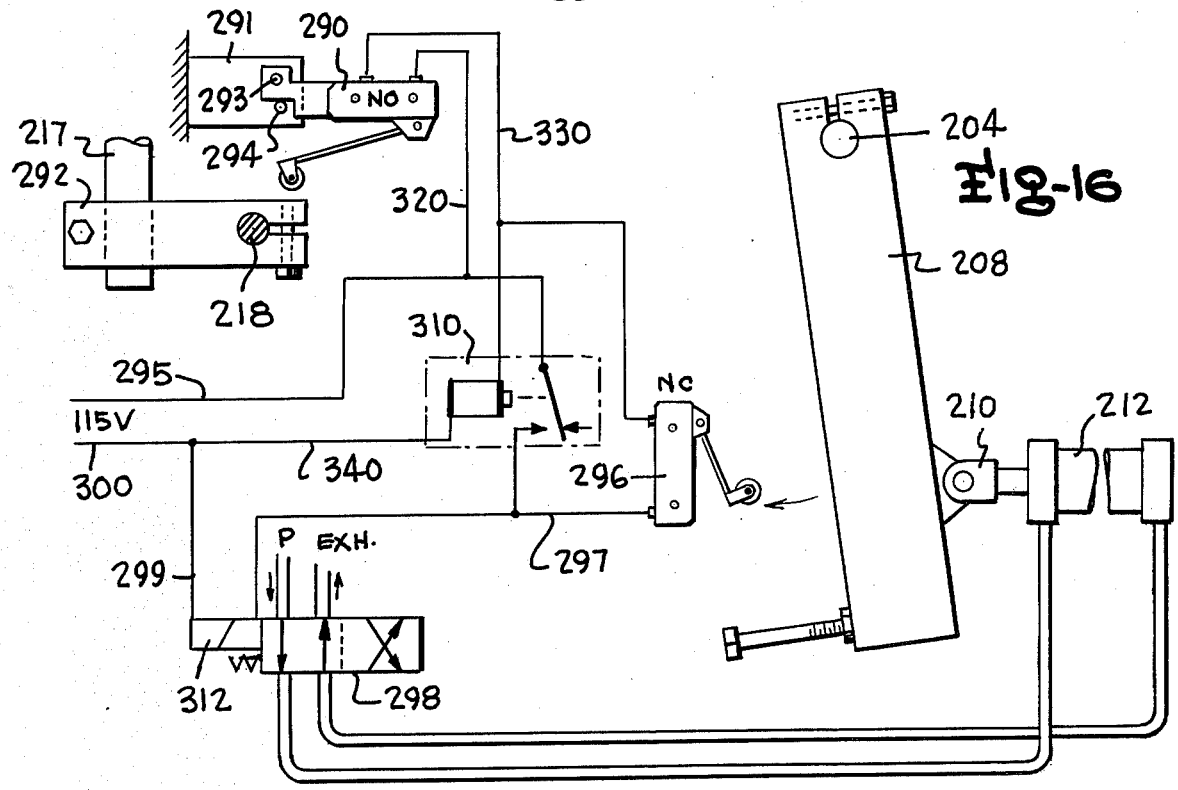
Fig-16

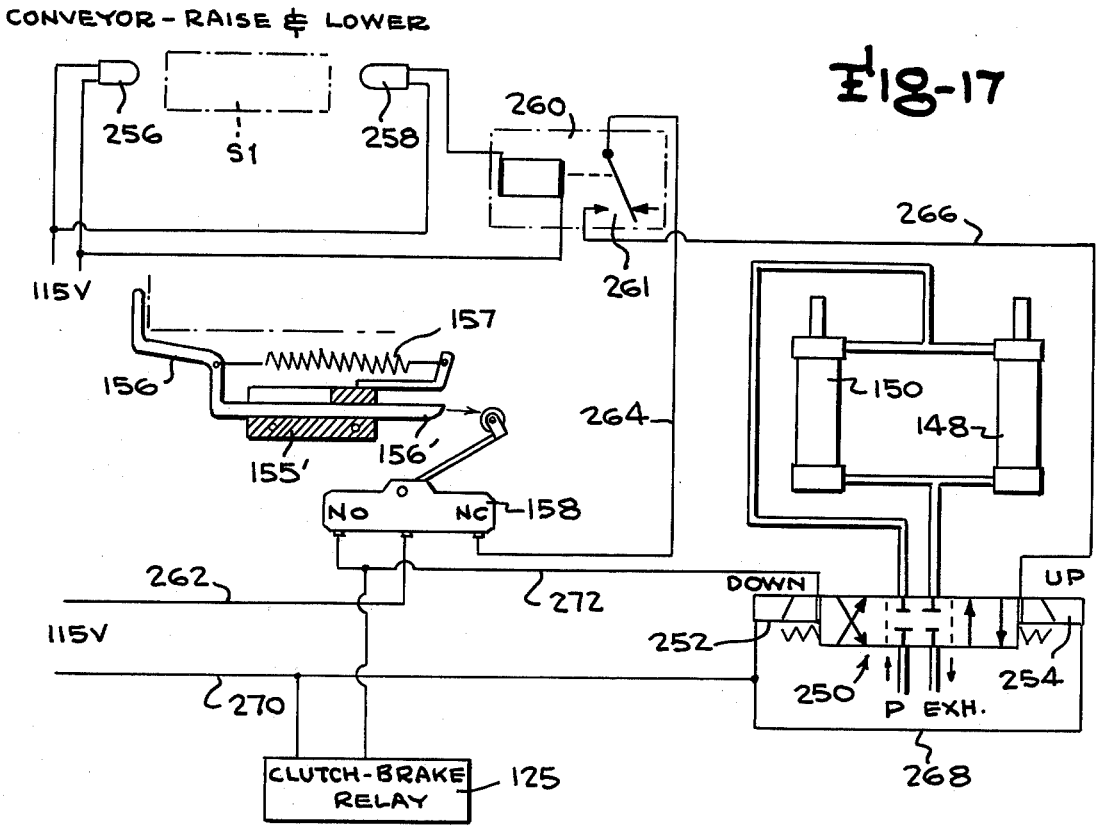
Fig-17
Fig-18
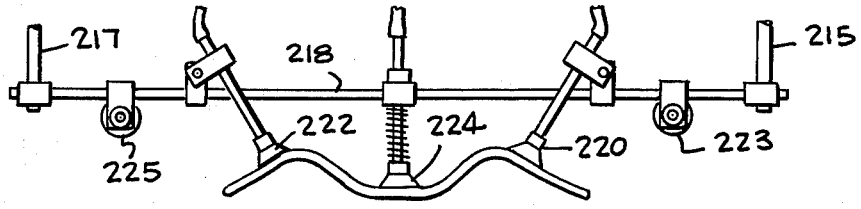
Fig-19
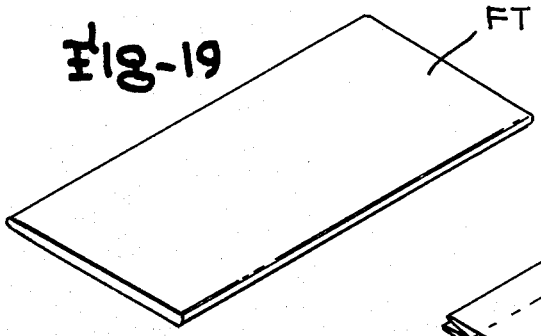
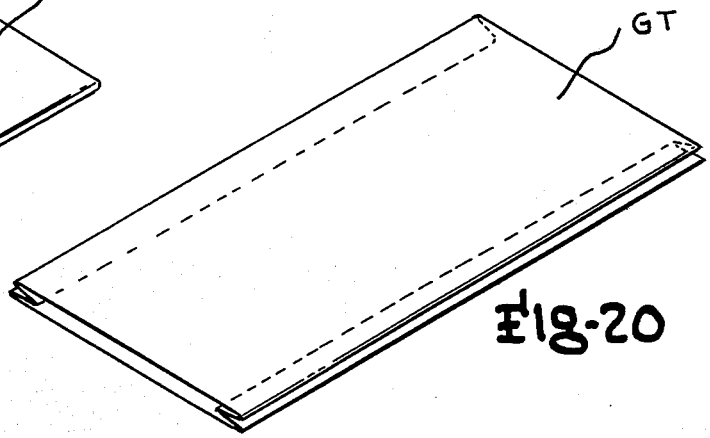
Fig-20

AUTOMATIC BAG TUBE FEEDER

This invention is in the field of bag tube feeding apparatus and is specifically directed to automatic means for feeding bag tubes to the infeed conveyor of a sewing head for closing the tube ends.

Sewing heads used for closing bag tubes are frequently used with infeed conveyor belts of the type having protruding lugs engageable with the bag tubes for conveying the tubes to the sewing apparatus such as shown in my previous U.S. Pat. No. 3,782,305. In order for an efficient operation to be provided, it is necessary that the bag tubes be presented to the sewing apparatus as quickly and uniformly as possible without any interruptions in the feeding occurring. Hand feeding of the bag tubes to the infeed conveyors has been a common practice in the industry; however, such manual labor is both expensive and frequently unreliable.

Other systems which have been previously employed include the providing of a plurality of vertical stacks of bag tubes on an upwardly moving conveyor adjacent the infeed conveyor which must be manually deposited onto the infeed conveyor as they are moved upwardly. Another approach has been to provide a shingled array of the bag tubes on a horizontal conveyor for supplying the infeed conveyor. Neither of the foregoing expedients is entirely successful in that they require manual labor including both the deposit of tubes on the infeed conveyor and the monitoring of the system with each sewing head requiring at least one operator for its operation.

Therefore, it is the primary object of this invention to provide a new and improved bag tube feeding means.

Another object of the invention is the provision of a new and improved bag tube feeding means requiring a minimum amount of operator labor or supervision.

Achievement of the foregoing objects is enabled by the preferred embodiments of the invention in which a horizontally extending stack feed conveyor is provided with a pivotal support at its rear end and is supported at its front or discharge end by pneumatic cylinder means. A plurality of stacks of bag tubes are stacked in an aligned manner on conveyor belts of the conveyor and a plurality of suction cups are supported above the stack positioned at the downstream end of the conveyor in an outfeed station. The suction cups are moved downwardly to engage the uppermost bag tube and then lift it vertically upwardly to an elevated position with the suction cups then being swung about a horizontal pivot to position the edge of the lifted bag tube in the bite of a roller and conveyor belt driven at a constant speed. As the lifted bag tube enters the bite of the roller and the conveyor belt, automatic means terminates the application of suction to the suction cups and the bags are released to be fed by the roller and the belt to the infeed conveyor of a sewing head system. The suction cups then swing backwardly to their original position to await a new cycle of operation for lifting the next bag tube and feeding it to the infeed conveyor of the sewing head in the same manner.

As the stack of sheets in the outfeed station is depleted, the downstream end of the conveyor is automatically lifted upwardly by the pneumatic cylinder means which is controlled by an electric eye receiving a light beam directed across the uppermost area in which the stack is normally positioned. When the stack is depleted sufficiently, the electric eye is activated to move the conveyor end upwardly so that the uppermost sheet of the stack of sheets in the outfeed position is always provided in a desired area to be easily engaged by the suction cups. The stack in the outfeed station is eventually depleted and such depletion is automatically detected by a mechanical feeler device which actuates the stack feed conveyor means to move the next adjacent stack into the outfeed position.

Another important feature of the invention resides in the provision of a suction cup in the conveyor bed below the stack of bag tubes in the outfeed position which suction cup holds the lowermost bag tube in position when the next above bag tube is being removed by the movable suction cup members.

The operation of the preferred embodiment is entirely automatic and the only manual labor required is for the operator to provide a plurality of aligned stacks of bag tubes on the stack feed conveyor. Consequently, a single operator can handle a plurality of sewing head feed systems to result in a substantial savings over prior known systems in which a single operator was required for each sewing head feed system.

A better understanding of the manner in which the preferred embodiment achieves the foregoing objects will be enabled when the following written description is considered in conjunction with the appended drawings in which:

FIG. 15 is a sectional view taken along lines 15—15 of FIG. 8;

FIG. 16 is a mechanical-electrical-pneumatic schematic view of control components of the preferred embodiment;

FIG. 17 is a mechanical-electrical-pneumatic schematic diagram of control components for raising and lowering the tube stacks employed with the preferred embodiment;

FIG. 18 is an elevation view illustrating the manner in which the uppermost bag of a stack of bags is lifted from a stack;

FIG. 19 is a pictorial view of a non-gusseted plain bag tube; and

FIG. 20 is a perspective view of a gusseted bag tube.

Figure 1:
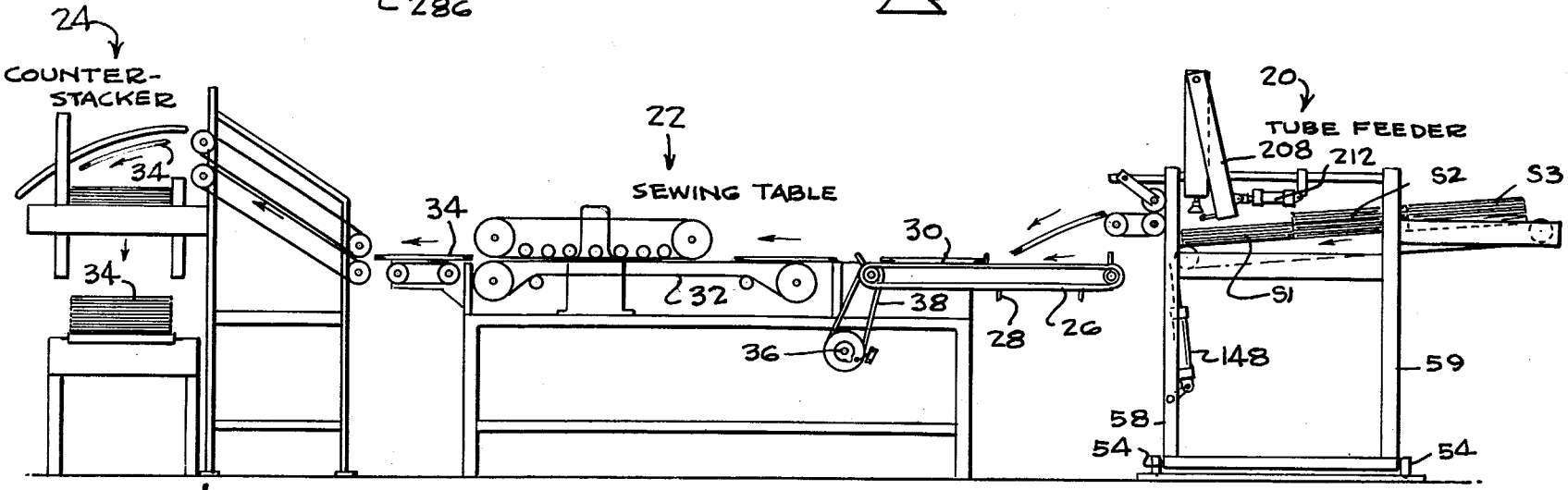
FIG. 1 is a front elevation view of the preferred embodiment bag tube feeding means as associated in conjunction with associated sewing and stacking means to which the preferred embodiment feed bag tubes.

Attention is initially invited to FIG. 1 of the drawings which illustrates the manner in which the preferred embodiment 20 of the bag tube feeder is associated with a sewing table 22 and a counter stacker 24. Sewing table 22 includes an infeed conveyor 26 having spaced feed lugs 28 for feeding bag tubes 30 to a sewing station conveyor 32 which feeds the bag tubes through the sewing apparatus which stitches one end of the tube to effect a closure of the tube end in a well-known manner to convert the tube into a bag 34 which is fed to the counter stacker 24.

Figure 3:
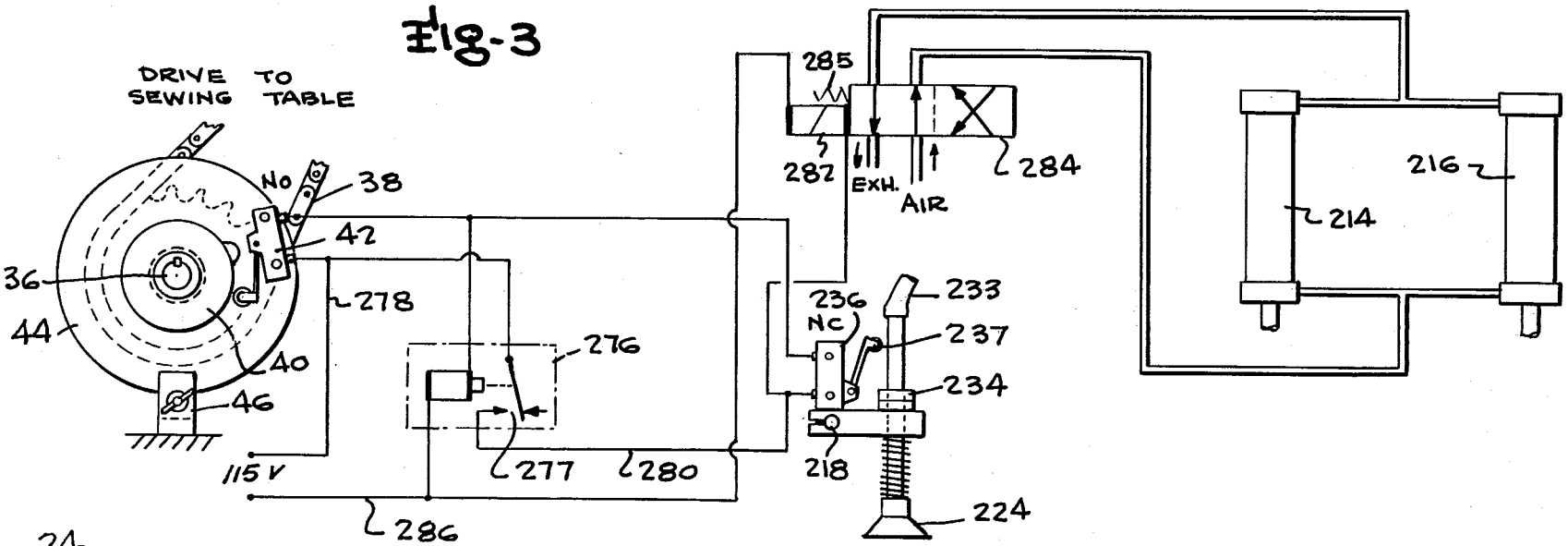
FIG. 3 is a schematic diagram of a portion of the mechanical, electrical and pneumatic control system of the preferred embodiment.

Drive for the sewing table is provided from a shaft 36 to which a sprocket is keyed with a chain 38 extending from the sprocket upwardly to drive the infeed conveyor 26 in timed relation to the other components in a manner that will be obvious from inspection of FIG. 1 and 3. A switch actuator cam 40 is keyed to shaft 36 for actuating a normally open microswitch 42 mounted on a fixed support disc 44. However, support disc 44 is held in adjusted position by a clamping means 46 so that the disc 44 can be rotated to a desired position with respect to switch actuator cam 40 to achieve a proper timed engagement of the switch actuator with the switch member in an obvious manner. The purpose of switch 42 etc. will be discussed hereinafter.

Figure 2:
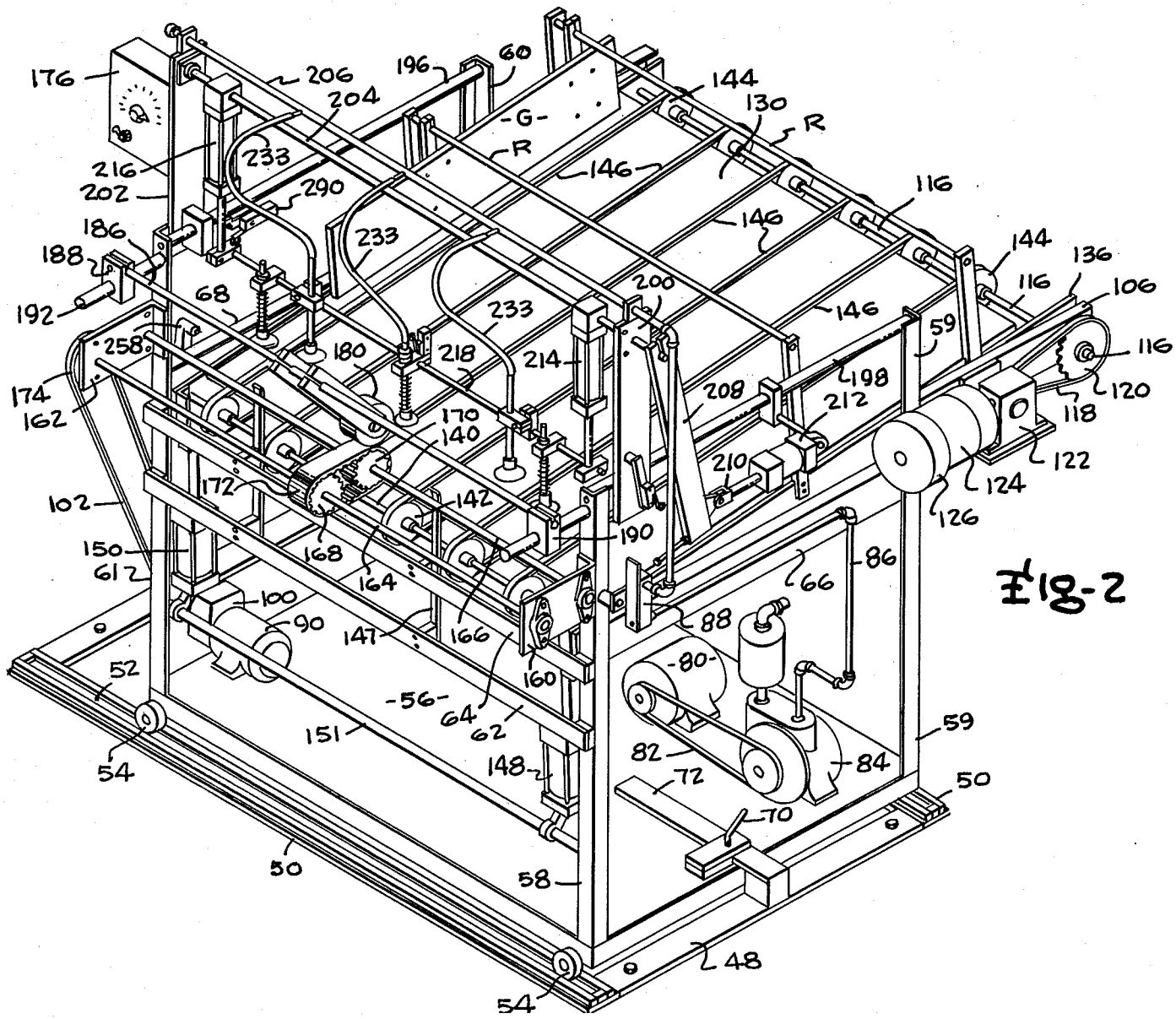
FIG. 2 is a perspective view of the preferred embodiment of the bag tube feeding means.

Tube feeder 20 consists of a support base 48 including side members 50 in which guide grooves 52 are provided for receiving wheels 54 of an adjustable carriage frame on which the operative components are provided. The carriage frame includes a base plate 56 and vertically extending corner frame elements 58, 59, 60 and 61. Corner frame elements 58 and 61 are joined by horizontal frame members 62 and 64 and corner frame element 58 is also connected to corner frame member 59 by a horizontal member 66 as best shown in FIG. 2. Additionally, a horizontal frame member 68 extends between the corner frame elements 61 and 60. Wheels 54 permit the base plate 56 etc. to be adjusted along the length of guide grooves 52 in an obvious manner and a locking member 70 engages a lock plate 72 fixedly attached to the support base 48 to hold the carriage in a desired position of adjustment.

Figures 5, 6, 7:
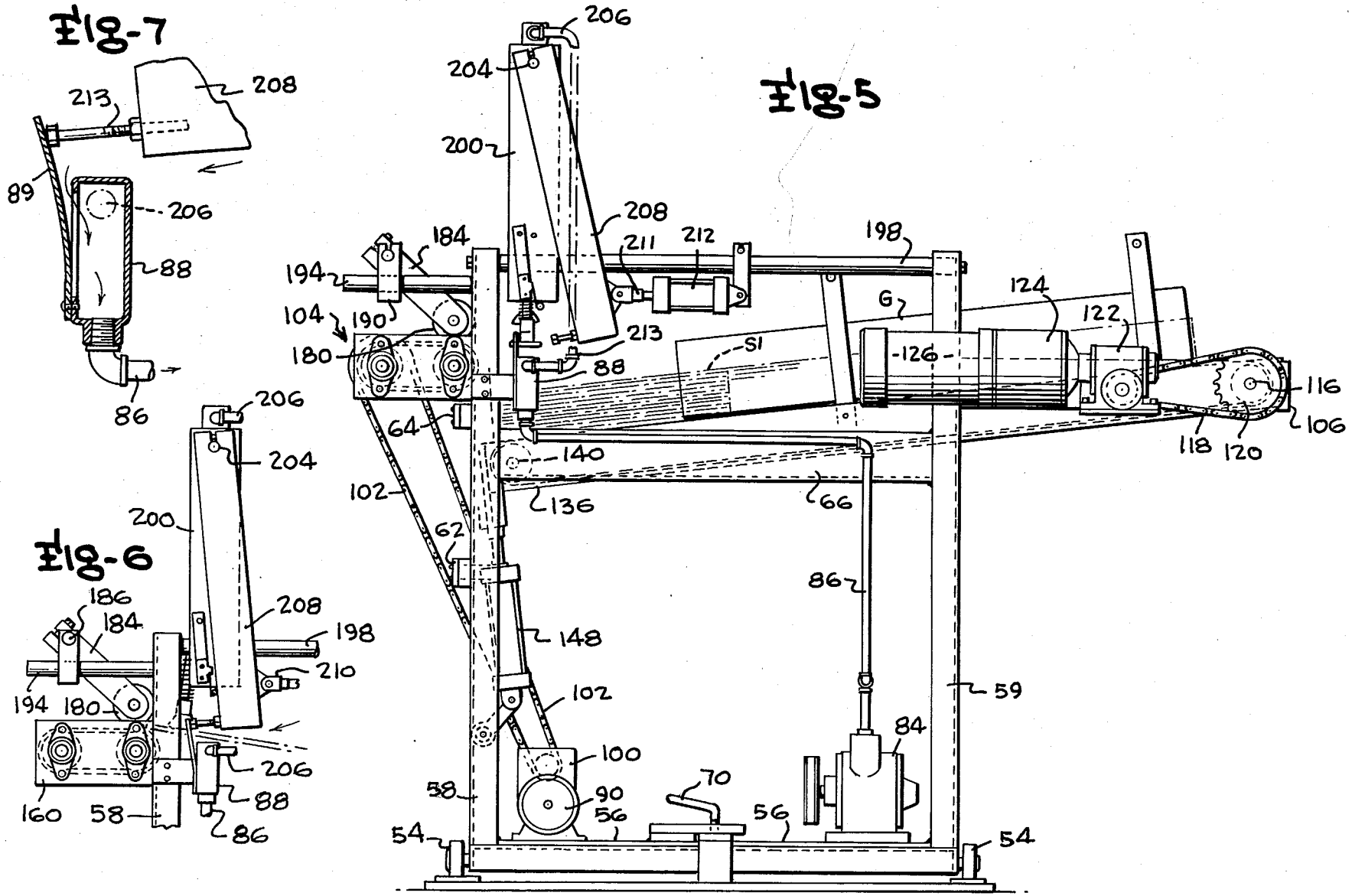
FIG. 5 is a front elevation view of the preferred embodiment of the bag tube feeding means of FIG. 2.
FIG. 6 illustrates a portion of FIG. 5 in a different operating position during the feeding of the uppermost bag tube from a stack carried by the bag feeder.
FIG. 7 is an enlarged view of a portion of the structure of FIG. 6 which is partially in section.

A vacuum pump motor 80 is connected by a belt 82 to a vacuum pump 84 from which a vacuum line 86 extends upwardly to a vacuum breaker 88, the purpose of which will be discussed hereinafter. A variable speed outfeed drive motor 90 is also mounted on the base plate 56 and is connected to a speed reducer 100 having an output connected to a chain 102 extending upwardly for driving engagement with tube outfeed means generally designated 104 as shown in FIG. 5.

Figure 4:
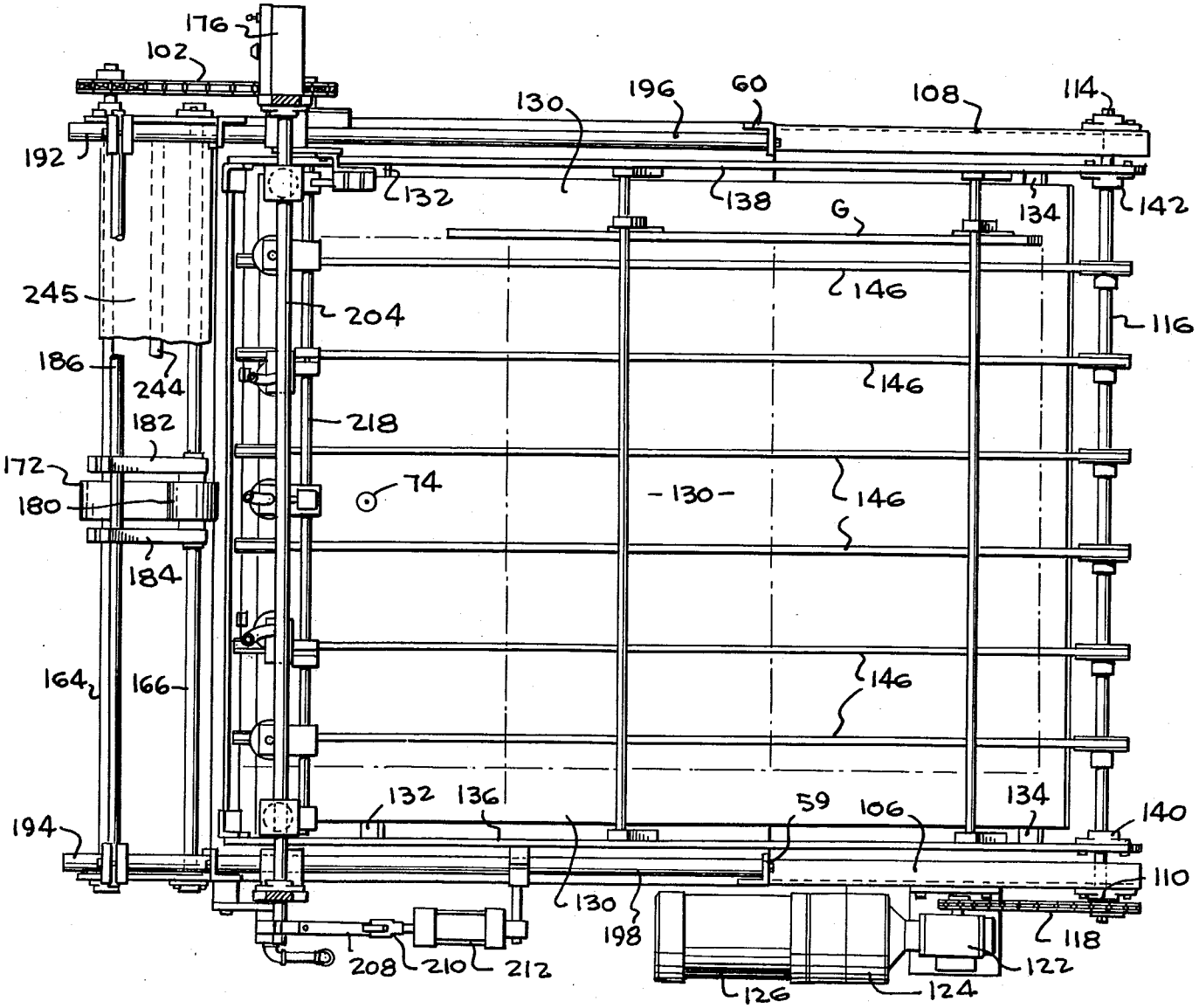
FIG. 4 is a plan view of the bag tube feeding means of FIG. 2.

First and second cantilever frame members 106 and 108 respectively extend outwardly of the corner frame elements 59 and 60 as best shown in FIGS. 2 and 4. The outer ends of the cantilever frame members 106 and 108 support aligned rotary bearings 110 and 114 respectively which provide rotary support for a conveyor drive shaft 116. A chain 118 is mounted on a sprocket 120 keyed to the end of conveyor drive shaft 116 with the other end of the chain extending about the output of a speed reducer 122 having an input connected to the output of a combination brake-clutch 124 driven from a conveyor drive motor 126. Brake-clutch means 124 is a conventional device of the type in which the brake is disengaged and the clutch is simultaneously engaged for transmitting movement from the motor when a control relay (FIG. 17) is activated with deactivation of the relay causing the simultaneous disengagement of the clutch and activation of the brake for preventing any further movement of the output member connected to the input of speed reducer 122.

Figures 9, 13, 14:
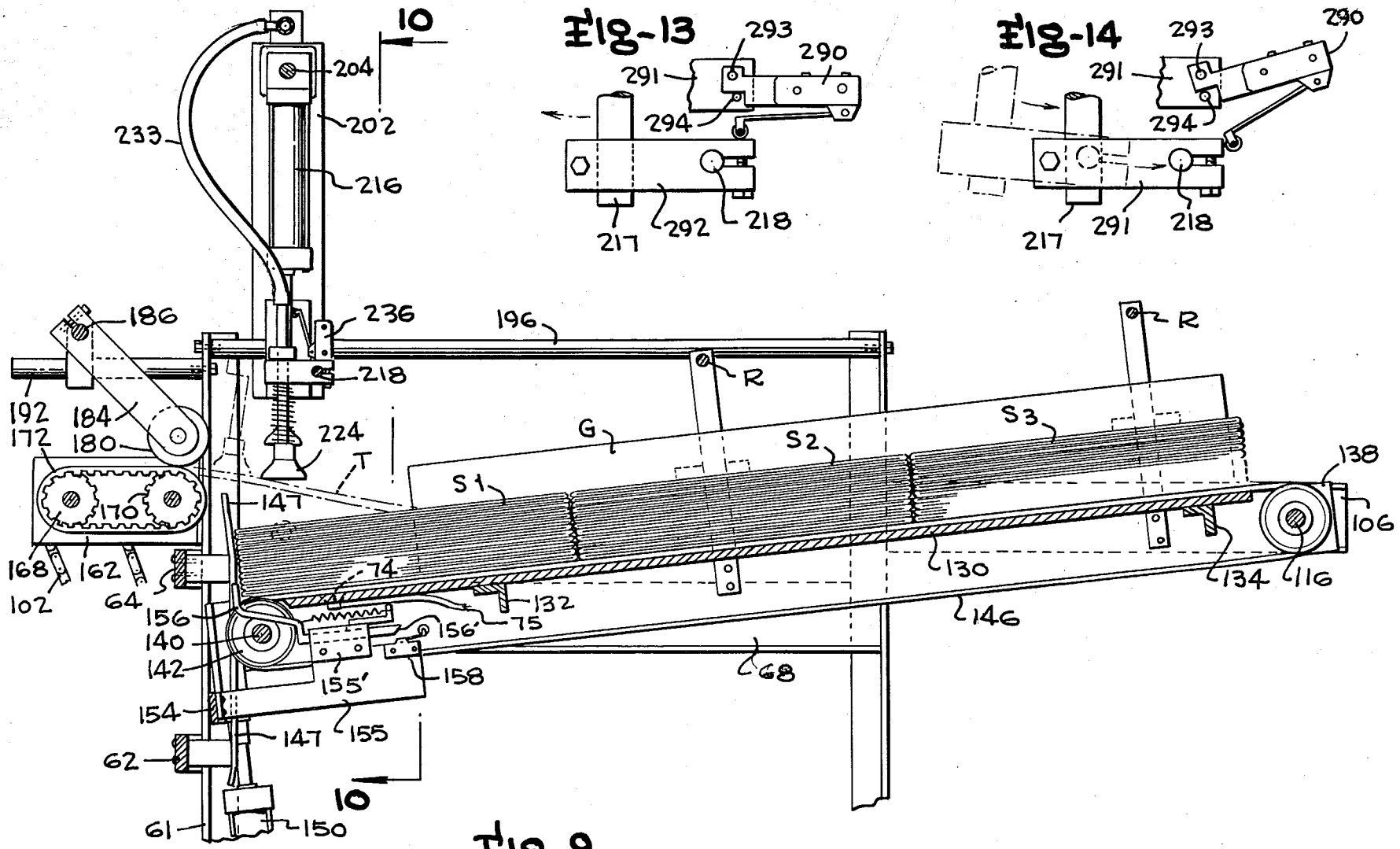
FIG. 9 is a sectional view taken along lines 9—9 of FIG. 8.
FIG. 13 is a sectional view taken along lines 13—13 of FIG. 10 and illustrating a portion of the control means for the bag tube feeding means.
FIG. 14 is a view similar to FIG. 13 but illustrates the parts in a different operative position.

Conveyor drive shaft 116 provides pivotal support for the rear end of a stack conveyor which includes a plywood top 130 fastened to transverse frame elements 132 and 134 shown in FIG. 9 which extend between and are connected to pivotal side frames 136 and 138 which respectively have bearing members 140 and 142 mounted on the conveyor drive shaft 116. Consequently, the conveyor framework consisting of the elements 130, 132, 134, 136 and 138 is capable of pivotal movement as a unit about the shaft 116. The opposite ends of the pivotal side frame members 136 and 138 from those ends mounted on shaft 116 support a transverse conveyor shaft 140 on which a plurality of idler pulleys 142 are provided.

Figure 8:
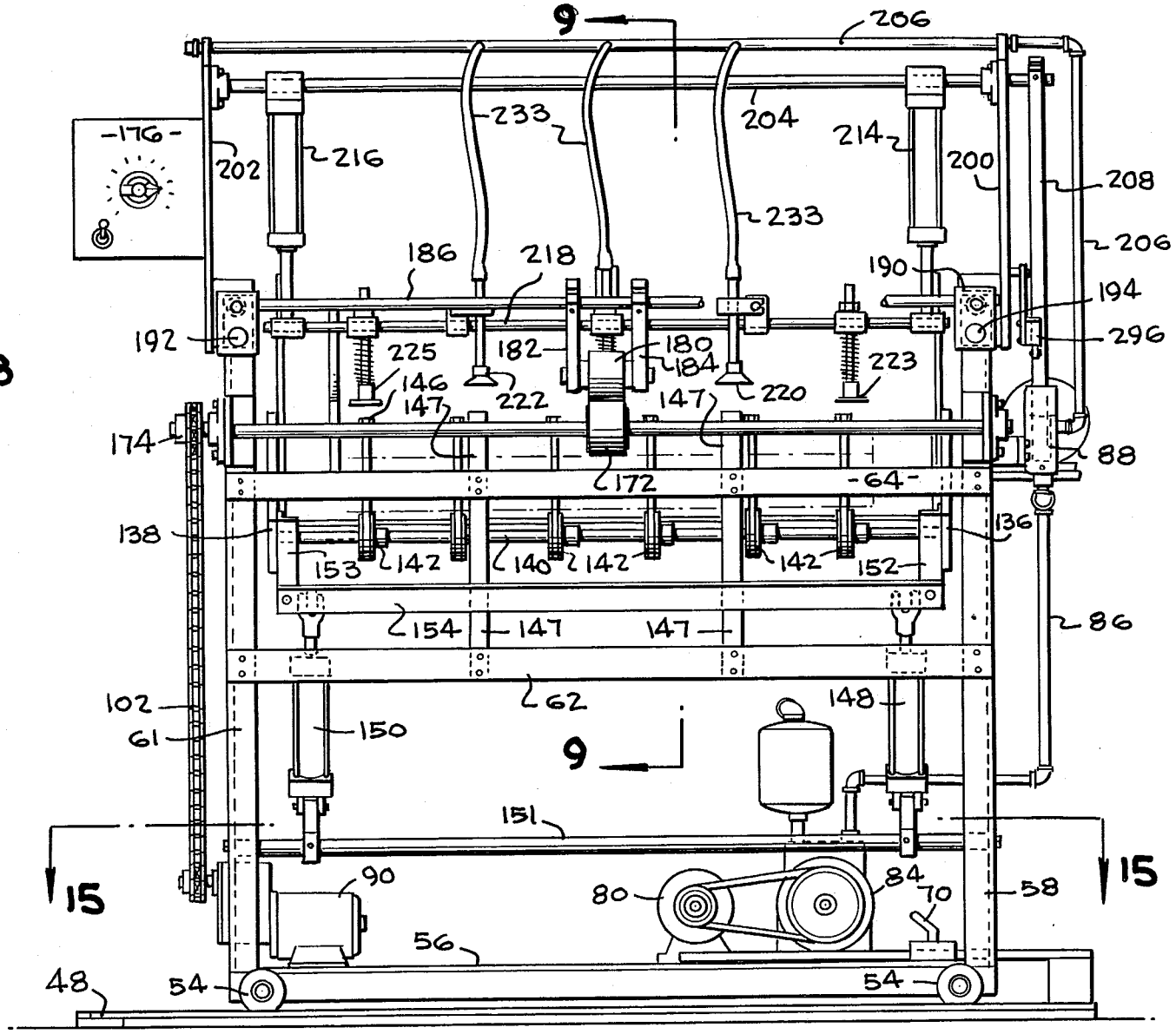
FIG. 8 is a side elevation view of the preferred embodiment of the bag tube feeding means.

Driven pulleys 144 are keyed to the conveyor drive shaft 116 and conveyor belts 146 extend between the driven pulleys 144 and the idler pulleys 142 so that rotation of shaft 116 serves to move the upper flights of the conveyor belts 146 which rest on plywood top 130 from right to left as viewed in FIGS. 2, 4 and 9 in an obvious manner. Plural stacks S1, S2 and S3 of bag tubes are supported on belts 146 with the front edge of the tubes of stack S1 engaging a pair of front stop members 147 fixedly mounted on horizontal frame members 62 and 64 as shown in FIGS. 2, 8 and 9. The uppermost bags of stack S1 are fed to infeed conveyor 26 one at a time from the stack until the stack is exhausted at which time belts 146 will be driven, in a manner to be discussed, to position stack S2 against stops 147 to permit the subsequent feeding of the bags from this stack to the infeed conveyor 26 with the process being repeated automatically for successive stacks. A movable side guide plate G is adjustably supported on rods R mounted on pivotal side frames 136 and 138 to be moved in and out to accommodate bag tubes of different lengths.

The forward ends of pivotal side frames 136 and 138 are supported for vertical movement by air cylinders 148 and 150 pivotally mounted on a transverse rod 151 extending between the corner frame elements 58 and 61 as best shown in FIGS. 2 and 8. The upper ends of the rods of air cylinders 148 and 150 are connected to a U-shaped frame fixed to the pivotal side frame members 136 and 138 and consisting of downwardly extending side legs 152 and 153 connected by a horizontal frame element 154 with the upper ends of the side frame members 152 and 153 being respectively connected to the pivotal side frame members 136 and 138.

A bracket 155 is attached to the horizontal frame element 154 and extends up under plywood sheet 130 to provide support for a movable stack detector slide 156 (FIGS. 9 and 12) mounted for sliding movement in an aperture in a mounting block 155′ on bracket 155 and normally biased to the right by spring means 157 as viewed in FIG. 9. A microswitch 158 has an actuator 158′ positioned to be engaged and actuated by end portion 156′ of slide 156 when the slide 156 is moved to its extreme righthand position by spring 157 upon the absence of a bag tube in the position of stack S1; however, the stack detector slide is normally in the position illustrated in FIGS. 9 and 17 due to the presence of a stack in the working stack station of stack S1. A suction cup 74 (FIG. 9) connected by flexible tube 75 to the vacuum pump 84 is mounted in plywood sheet 130 to exert attracting force on the lowermost bag tube of stack S1 for a purpose discussed hereinafter.

Forwardly extending bracket plates 160 and 162 are mounted on the corner frame elements 58 and 61 and support a pair of parallel shafts 164 and 166 which in turn are provided with gear belt pulleys 168 and 170 over which a gear belt 172 extends. A sprocket 174 is keyed to the end of shaft 164 and chain 102 extends about sprocket 174 so that rotative power from variable speed motor 90, speed reducer 100 and chain 102 is conveyed to shaft 164 and then conveyed through the gear belt 172 to shaft 166. The speed of rotation of the variable speed motor 90 is adjustable by conventional control means 176.

Figures 10, 11, 12:
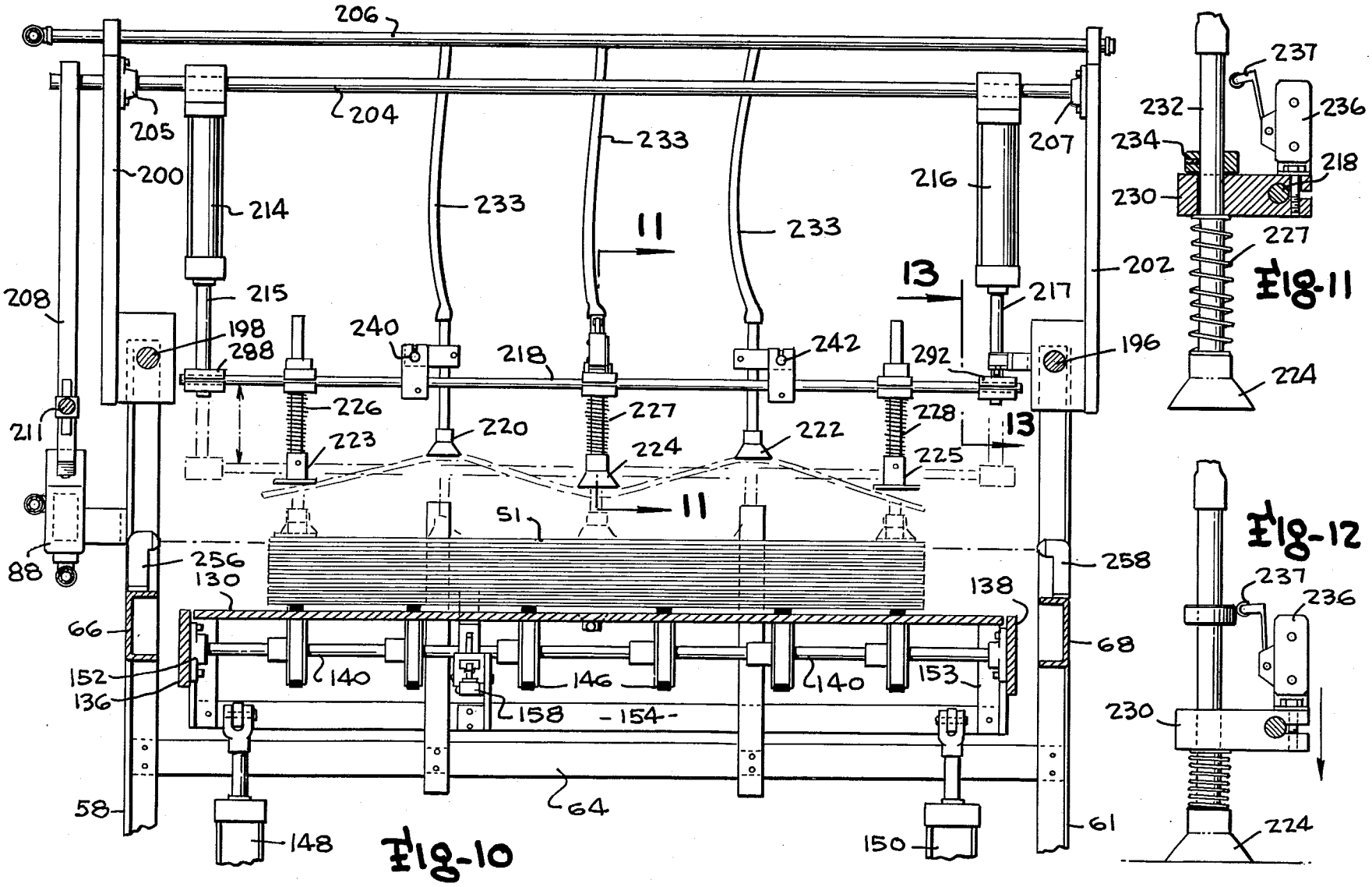
FIG. 10 is a sectional view taken along lines 10—10 of FIG. 9.
FIG. 11 is a sectional view taken along lines 11—11 of FIG. 10.
FIG. 12 is a view similar to FIG. 11 but illustrates the parts in a different operative position.

A tube hold-down idler roller 180 is positioned immediately above and normally rests on the upper surface of the gear belt 172 and is supported for rotation on pivotal bracket arms 182 and 184 mounted on a transverse shaft 186. Shaft 186 is supported at its opposite ends by clamp bracket blocks 188 and 190 mounted on the corner frame members 61 and 58. Additionally, a support rod 196 (FIG. 9) extends between and is supported by the upper ends of the corner frame elements 60 and 61 and a similar support rod 198 (FIGS. 5 and 4) extends between the corner frame members 58 and 59. An upwardly extending support plate 200 is attached to the support rod 196 and a similar upwardly extending support plate 202 is attached to and supported by the rod 198 as best shown in FIGS. 8 and 10. A pivot shaft 204 is mounted in bearings 205 and 207 adjacent the upper ends of the plates 200 and 202 and a vacuum line 206 connected to the vacuum breaker 88 is also supported on the upper ends of the support plates 200 and 202. A swing arm 208 is keyed to the end of pivot shaft 204 and has its lower end connected to a clevis 210 mounted on the rod 211 of a pneumatic cylinder 212 pivotally attached to support rod 198. Operation of cylinder 212 serves to pivot the swing arm 208 and pivot shaft 204 in an obvious manner with such swinging movement causing a bolt 213 attached to the lower end of arm 208 to engage a reed valve 89 on vacuum breakers 88 to vent the interior of the vacuum breaker to atmosphere as shown in FIG. 7 for a purpose to be discussed hereinafter.

First and second suction cup raising and lowering cylinders 214 and 216 are fixedly attached at their upper ends to pivot shaft 204 so that pivotal movement of shaft 204 also results in pivotal movement of the cylinders 214 and 216. The rods 215 and 217 of cylinders 214 and 216 have a transverse support rod 218 mounted on their lower ends by clamp blocks 288 and 292 for providing support for a plurality of suction cups including fixedly positioned suction cups 220 and 222 (FIG. 10) which are fixedly connected to the shaft 218 and a downwardly biased suction cup 224 which is supported on shaft 218 but which is movable vertically and is biased downwardly by a compression spring 227. All of the suction cups are connected by flexible tubes 233 to vacuum line 205.

FIG. 11 illustrates the manner in which the downwardly biased suction cup 224 is mounted on and supported by the transverse rod 218. Specifically, a bracket 230 is clamped on rod 218 and is provided with an aperture in which a movable hollow tube 232 is positioned with the suction cup 224 being positioned on the lower end of the tube as shown. Spring 227 biases the tube and suction cup downwardly with an upper positioning collar 234 limiting the extent of downward movement of the tube. Additionally, two downwardly biased aluminum pusher plates 223 and 225 are biased downwardly by springs 226 and 228 and are mounted in exactly the same manner as cup 224 but are not connected to a vacuum source.

It should also be noted that the middle suction cup 24 is associated with a normally closed microswitch 236 which is part of the control circuitry of FIG. 3. FIG. 11 illustrates the microswitch 236 in its normally closed condition while FIG. 12 illustrates the microswitch in an open condition effected by engagement of the microswitch actuator 237 with the collar 234 when the tube 232 is moved upwardly with respect to bracket 230 as shown in FIG. 12. Such movement occurs upon a lowering of support rod 218 upon extension of cylinders 214 and 216 as will be discussed in detail hereinafter. Flexible hose members 233 extend between the suction cups 220, 224 and 222 and the vacuum line 206 which is connected to the internal chamber of vacuum breaker 88.

It should be noted that the suction cups 220 and 222 can be optionally pivoted about pivot axes 240 and 242 to be held in an adjusted canted position such as illustrated in FIG. 18. The position selected for the suction cups depends upon the nature of the bags being fed.

FIG. 17 illustrates the control mechanism for air cylinders 148 and 150 which operate to raise and lower the outfeed end of the pivotal conveyor means. This control means includes a double solenoid air valve 250 having a down solenoid 252 which, when activated, positions the valve member to provide pressurized air to the upper ends of the cylinders 148 and 150 for lowering the conveyor and an up solenoid 254 which, when activated, positions the valve member to provide pressurized air to the lower ends of the cylinders 148 and 150 for effecting a raising of the conveyor end by extension of the cylinders in an obvious manner. Additionally, the air valve 250 is provided with spring means for positioning the movable valve member in an intermediate or blocking position illustrated in FIG. 17 in which the cylinders are maintained in a fixed position.

A light source 256 and a photo-electric cell 258 are positioned on opposite sides of stack S1 as best shown in FIG. 10 so that the positioning of the stack is such as to normally interrupt a beam of light from the light source 256 as directed toward the photo-electric cell 258. However, when a number of bag tubes have been removed from the stack S1, the top of the stack moves downwardly a sufficient distance to cause the light beam from source 256 to enter the photo-electric cell 258 to activate a relay 260 to close the contacts 261 of the relay. Closure of the contacts 261 of relay 260 completes a circuit from power supply line 262 through the normally closed switch contacts of microswitch 158, conductor 264, the contacts 261 of the relay 260, conductor 266, up solenoid 254 and conductor 268 to the power supply line 270 so that valve 250 is positioned to provide air to cylinders 148 and 150 to extend the cylinders and lift the forward end of the stack conveyor upwardly until such time as the top of the stack interrupts the light beam from source 256. Upon interruption of the light beam, relay 260 is deactivated to consequently deactivate the up solenoid 254 and permit the valve 250 to return to its neutral blocking position illustrated in FIG. 17 in which position it will remain until the top of the stack is again sufficiently depleted to permit the light beam to activate photo-electric cell 258 in the previously discussed manner to result in a subsequent further extension of the cylinders 148 and 150 to lift the stack upwardly until the light beam is again interrupted.

However, the stack S1 will eventually be completely depleted and it will then be necessary to lower the forward end of the conveyor to permit the conveyor belts 146 to be activated to move the next stack S2 into feeding position.

Lowering of the forward end of the conveyor is initiated upon the depletion of the forward stack by movement of the stack detector slide 156 from its solid line position of FIG. 17 to the right so that the end 156' of the slide engages switch 158 to close the normally open contacts of the switch and complete an electrical circuit from conductor 262 through the normally oepn contacts to conductor 272 and down solenoid 252 to power supply conductor 270 to position the valve 250 in the down position to retract the cylinders 148 and 150 in an obvious manner. Actuation of switch 158 also serves to actuate the clutch-brake relay 125 to initiate movement of conveyor belts 146 to move the next stack S2 into feeding position. The valve 250 is maintained in the "down" position until the next stack moves aganst the forward end of the slide 156 to permit the switch 158 to again open and terminate activation of relay 125 and permit valve 250 to return to its neutral position of FIG. 17.

The bag tube feeding apparatus of the preferred embodiment can be used for feeding simple flat tube bag tubes FT as illustrated in FIG. 19 or for gusset tube bag tubes as illustrated in FIG. 20. The basic operation of feeding the bag tubes from the top of the stack S1 involves an initial lowering of the suction cups in a vertical manner by extension of cylinders 214 and 216 downwardly until the suction cups are fully engaged with the uppermost bag tube of the stack. Cylinders 214 and 216 are then contracted to lift the suction cups and the uppermost bag tube from the stack vertically upward to an elevated position with the cups being positioned in the position of cup 224 of FIG. 9. Cylinder 212 is then activated to swing the suction cups from the solid line position of FIG. 9 to the dotted line position of the same figure to position the leading edge of the bag tube T carried by the suction cup in the bite of roller 180 and belt 172. Movement of the roller 180 and belt 172 effects a removal of the bag tube T which is deposited on the conveyor 26 of FIG. 1.

It should be noted that a support rod 244 extends the bracket plates 160 and 162 and passes beneath the upper flight of belt 172 for supporting first and second sheet metal shields 245 positioned above the shafts 164 and 166 on opposite sides of the belt 172 for the purpose of keeping the bag tube out of contact with the shafts 164 and 166 as the bag tube is being fed to the conveyor 26. Only a portion of one of the shields 245 and the supporting rod 244 is illustrated in FIG. 4; however, it should be understood that a similar shield is provided on the other side of the belt 172. The shields are of particular benefit when feeding bag tubes of substantial length in which case the ends of the bag tubes tend to droop into the area of shafts 164 and 166 as the bag tube is being fed between the roller 180 and the belt 172. The shields 245 have not been illustrated in the other drawings since they would tend to obscure the other operative components of the preferred embodiment.

FIG. 16 illustrates the components of the control circuitry for controlling operation of the cylinder 212 for effecting a swinging cyclic operation of the swing arm 208 while FIG. 3 illustrates the control components for controlling the operation of cylinders 214 and 216 for raising and lowering the suction cups 224 etc. A cycle of operation is initiated by closure of the contacts of normally open microswitch 42 by the cam means 40 to activate a latching relay 276 to close the contacts of the relay and complete a circuit from power line 278 through relay 276 to conductor 280 to the coil 282 of a valve 284 to power line 286. Completion of the circuit through coil 282 positions valve 284 to provide air to the upper ends of cylinders 214 and 216 so that the cylinders are extended and the transverse support rod 218 lowered in an obvious manner.

Lowering of the transverse support rod 218 results in engagement of the upper bag tube first by the suction cup 224 followed by engagement of suction cups 220 and 222 with the uppermost bag tube of stack S1. Tube 232 is moved upwardly with respect to the bracket member 230 until such time as the collar 234 engages the switch actuator 237 of normally closed microswitch 236 to open the contacts of microswitch 236. It should be appreciated that relay 276 is a holding relay and that switch 42 is only closed for a short period of time during rotation of the switch actuator cam 40; however, the closing of switch 42 serves to latch solenoid 276 in the activated position with its contacts closed. Consequently, valve coil 282 remains activated until switch 236 is activated to open the contacts of switch 236 to terminate the flow of current through coil 282 and to unlatch the coil of relay 276. Consequently, spring 285 of valve 284 returns the valve to the position illustrated in FIG. 3 to initiate contraction of cylinders 214 and 216. As rod 218 moves upwardly, the uppermost bag tube us lifted by the suction cups and assumes an M-shaped configuration as shown in dotted lines in FIG. 10.

Operation of the cylinder 212 for swinging the swing link 208 to move the bag tube held by the suction cups to the bite between belt 172 and roller 180 must be closely synchronized with the operation of the cylinders 214 and 216 and FIGS. 13, 14 and 16 best illustrate the control means for effecting this purpose. Specifically, a normal open microswitch 290 is mounted on a support block 291 supported on support rod 196 in a position adjacent clamp means 292 attached to the lower end of the piston rod 217 of the suction cup raising and lowering cylinder 216. Switch 290 is supported for pivotal movement about pivot pin 293 on support block 291 with the clockwise pivotal movement of the switch being limited by a fixed abutment pin 294 as best shown in FIG. 16. At the beginning of a cycle of operation, the suction cup raising and lowering cylinders 214 and 216 are in their contracted positions in which the suction cups are spaced above the top of the stack S1 as shown in FIG. 9.

Moreover, at the beginning of the cycle of operation, the normally open microswitch 290 is in the position illustrated in FIG. 14 in which the microswitch is pivoted upwardly as shown but the actuator has not been activated to close the normally open contacts of the switch 290. Consequently, the contacts of a swing arm control relay 310 are open due to the fact that the relay is not activated and a solenoid valve 298 is in the position illustrated in FIG. 16 in which the pressurized air is supplied to the rod end of cylinder 212 to contract the cylinder and hold the swing arm 208 in its retracted position of FIG. 16. It should be noted that activation of relay 310 serves to activate the control coil 312 of the relay to extend cylinder 212 and pivot swing arm 208 in a clockwise direction in an obvious manner.

A bag tube feeding cycle is initiated upon the closure of microswitch 42 by the switch actuator cam 40 (FIG. 3) which latches relay 276 and activates coil 282 of valve 284 to extend cylinders 214 and 216 to lower the transverse support rod 218 and permit switch 290 to move to its horizontal position engaged with pin 294 as shown in FIG. 16. Lowering of rod 218 also causes the suction cups 220, 224 and 222 to subsequently engage the uppermost bag tube of stack S1 with continued lowering movement of the shaft 218 eventually resulting in collar 234 engaging actuator 237 of normally closed microswitch 236 to open the contacts of microswitch 236. Opening of the switch contacts terminates the flow of current to valve 284 and the spring 285 returns the valve to the position illustrated in FIG. 3 to initiate a contraction of cylinders 214 and 216 and lifting of rod 218 upwardly. Vacuum is continuously supplied to the suction cups 220, 222 and 224 so that the uppermost bag tube is lifted from the top of the stack and assumes the M-shaped orientation of FIG. 10 to prevent the bag tube from opening up, a feature of particular utility when feeding gusset type tubes.

Continued upward movement of the transverse support rod 218 eventually results in engagement of the clamp block 292 with the actuator of the normally open microswitch 290 which is in the position illustrated in FIG. 16. As the block 292 continues to rise from the position of FIG. 16 to the position of FIG. 13, the contacts of the normally open microswitch 290 are closed to create a circuit from power supply line 295, conductor 320, switch 290, conductor 330, the coil of relay 310 and conductor 340 to power supply line 300. Relay 310 is consequently actuated to create a circuit from power supply line 295 through the contacts of relay 310 to conductor 297 and the actuator coil 312 of valve 298 and conductor 299 to power supply line 300. Valve 298 is consequently activated to provide pressurized air to cylinder 212 to extend the cylinder and swing the swing arm 208 in a clockwise direction. Swinging movement of arm 208 is conveyed to shaft 204 which in turn swings the cylinders 214 and 216 in a clockwise direction to the dotted position as viewed in FIG. 9 so as to carry the front edge of the lifted bag tube T of FIG. 9 to the bite between roller 180 and belt 172. Since belt 172 is being continuously driven, the tube is fed to the left as viewed in FIG. 9. However, it is necessary for the vacuum being supplied to the suction cups 200, 222 and 224 to be interrupted in order for the tube to be released for subsequent feeding. Such interruption is accomplished by engagement of bolt 213 with the reed valve member 89 of the vacuum interrupter 88 in the manner illustrated in FIG. 7. Consequently, the vacuum supply to the suction cups is interrupted and tube T is released as the arm 208 reaches its full extent of leftward movement which also results in the opening of normally closed switch 296. Opening of switch 296 terminates the supply of holding current to the relay 310 to unlatch the relay and also terminates the supply of current to coil 312 of valve 298 so that the valve is returned to its solid line position of FIG. 16 to initiate contraction of cylinder 212. Swing arm 208 and associated shaft 204 and cylinders 214, 216 are consequently swung in a counter-clockwise direction back to the initial position illustrated in FIG. 14. It should be understood that this return movement of the block 291 etc. results in engagement of the end of the block with the switch actuator of switch 290 to pivot the switch 290 upwardly in a counter-clockwise direction about pivot pin 293 to the final position illustrated in FIG. 14 so that the parts are again in position to initiate a feeding operation upon the next closure of switch means 42 by the switch actuator cam 40.

A more significant aspect of the invention resides in the fact that the provision of the suction cup 74 on the feed table serves to hold the lowermost bag tube in position when there are only two tubes remaining in the stack and the second tube is being lifted upwardly by the suction cup members. If it were not for the force exerted on the lower bag tube by the suction cup 74, both of the two remaining tubes of the stack would frequently be lifted upwardly by the movable suction cups to result in a malfunctioning of the feeding system. An additional advantage provided by the suction cup 74 resides in the fact that it holds the lowermost bag tube in position against the urging of the stack detector slide 156 when there is only one sheet remaining on the conveyor table; if it were not for the presence of the suction cup 74, relatively lightweight bag tubes would tend to be folded by the pressure of the stack detector slide 156 created by the spring 157.

Numerous modifications of the preferred embodiment will undoubtedly occur to those of skill in the art and it should be understood that the spirit and scope of the invention is to be limited solely by the appended claims.

I claim:

1. A bag tube feeding means comprising a supporting framework, a bag tube stack conveyor having an outfeed end defining an individual bag tube outfeed station and an infeed end for receiving and supporting a plurality of stacks of bag tubes, drive motor means for said bag tube stack conveyor, a plurality of movable suction cups, movable suction cup support means supporting said movable suction cups for movement about said outfeed station, individual bag tube outfeed means adjacent said outfeed station for receiving individual bag tubes fom said movable suction cups and removing said individual bag tubes to a desired discharge point, control means for said movable suction cups for sequentially lowering said movable suction cups to engage the uppermost bag tube of a stack of bag tubes in said outfeed station, lifting said movable suction cups and a supporting bag tube supported thereby to an elevated position and swinging said movable suction cups and said supported bag tube to a discharge position in which said supported bag tube is adjacent said individual bag tube outfeed means to be received thereby, conveyor control means for activating said drive motor means for said bag tube stack conveyor to feed a next adjacent stack of bag tubes to said outfeed station in immediate response to the depletion of a stack of bag tubes previously positioned in said outfeed station and elevation control means for automatically positioning and maintaining the upper end of a stack of bag tubes in said outfeed station within a desired height range by adjusting the elevation of the outfeed end of said bag tube stack conveyor.

2. The invention of claim 1 additionally including a vacuum source, conduit means connecting said vacuum source to said movable suction cups and means responsive to movement of said movable suction cups to said discharge position adjacent said individual bag tube outfeed means for terminating the connection of said vacuum source to said movable suction cups to permit the release of said supported bag tube from said movable suction cups.

3. The invention of claim 2 wherein said bag tube stack conveyor includes a conveyor platform, a plurality of conveyor belts having an upper flight extending along said conveyor platform, pivotal support means supporting said conveyor platform at the infeed end of said conveyor and wherein said elevation control means comprises pneumatic cylinder means connected to the outfeed end of said conveyor for raising and lowering the outfeed end of said conveyor.

4. A bag tube feeding means comprising a supporting framework, a bag tube stack conveyor having an outfeed end defining an individual bag tube outfeed station and an infeed end for receiving and supporting a plurality of stacks of bag tubes, drive motor means for said bag tube stack conveyor, a plurality of movable suction cups, movable suction cup support means supporting said movable suction cups for movement about said outfeed station, individual bag tube outfeed means adjacent said outfeed station for receiving individual bag tubes from said movable suction cups and removing said individual bag tubes to a desired discharge point, control means for said movable suction cups for sequentially lowering said movable suction cups to engage the uppermost bag tube of a stack of bag tubes in said outfeed station, lifting said movable suctions cups and a supported bag tube supported thereby to an elevated position and swinging said movable suction cups and said supported bag tube to a discharge posiiton in which said supported bag tube is adjacent said individual bag tube outfeed means to be received thereby, conveyor control means for activating said drive motor means for said bag tube stack conveyor to feed a next adjacent stack of bag tubes to said outfeed station in immediate response to the depletion of a stack of bag tubes previously positioned in said outfeed station and wherein said movable suction cup support means includes a pivot shaft extending horizontally above said outfeed station, first and second spaced suction cup raising and lowering pneumatic cylinder means having their cylinder ends mounted on said pivot shaft, a transverse support rod attached to the piston rods of said suction cup raising and lowering cylinders, said movable suction cups including first and second suction cups fixedly connected to said transverse support rod at spaced locations along the length of said transverse support rod and a relatively movable suction cup mounted for vertical movement on said transverse support rod between said two fixedly positioned suction cups, means normally biasing said relatively movable suction cup downwardly to an elevation below the elevation of said fixedly positioned suction cups so that extension of said suction cup raising and lowering pneumatic cylinders results in engagement of said vertically movable suction cup with the uppermost bag tube in said outfeed station prior to engagement of said fixedly positioned suction cups with said uppermost bag tube to cause said relatively movable suction cup to move upwardly with respect to said transverse support rod and lift initiating switch means responsive to said upward movement of said vertically movable suction cup for initiating contraction of said suction cup raising and lowering pneumatic cylinders to lift said movable suction cups and said supported bag tube to said elevated position, a swing arm attached to said pivot shaft, a swing cylinder connected on one end to said supporting framework and connected on an opposite end to said swing arm so that actuation of said swing cylinder effects a pivotal movement of said pivot shaft and said suction cup raising and lowering cylinder means to effect swinging movement of said movable suction cups to said discharge position.

5. The invention of claim 4 additionally including elevation control means for automatically positioning and maintaining the upper end of a stack of bag tubes in said outfeed station within a desired height range by adjusting the elevation of the outfeed end of said bag tube stack conveyor.

6. The invention of claim 4 additionally including a vacuum source, conduit means connecting said vacuum source to said movable suction cups and means responsive to movement of said movable suction cups to said discharge position adjacent said individual bag tube outfeed means for terminating the connecting of said vacuum source to said movable suction cups to permit the release of said supported bag tube from said movable suction cups.

7. The invention of claim 6 additionally including elevation control means for automatically positioning and maintaining the upper end of a stack of bag tubes in said outfeed station within a desired height range by adjusting the elevation of the outfeed end of said bag tube stack conveyor.

8. The invention of claim 7 wherein said bag tube stack conveyor includes a conveyor platform, a plurality of conveyor belts having an upper flight extending along said conveyor platform, pivotal support means supporting said conveyor platform at the infeed end of said conveyor and wherein said elevation control means comprises pneumatic cylinder means connected to the outfeed end of said conveyor for raising and lowering the outfeed end of said conveyor.

9. A bag tube feeding means comprising a supporting framework, a bag tube stack conveyor having an outfeed end defining an individual bag tube outfeed station and an infeed end for receiving and supporting a plurality of stacks of bag tubes, drive motor means for said bag tube stack conveyor, a plurality of movable suction cups, movable suction cup support means supporting said movable suction cups for movement above said outfeed station, individual bag tube outfeed means adjacent said outfeed station for receiving individual bag tubes from said movable suction cups and removing said individual bag tubes to a desired discharge point, control means for said movable suction cups for sequentially lowering said movable suction cups to engage the uppermost bag tube of a stack of bag tubes in said outfeed station, lifting said movable suction cups and a supported bag tube supported thereby to an elevated position and swinging said movable suction cups and said supported bag tube to a discharge position in which said supported bag tube is adjacent said individual bag tube outfeed means to be received thereby, conveyor control means for activating said drive motor means for said bag tube stack conveyor to feed a next adjacent stack of bag tubes to said outfeed station in immediate response to the depletion of a stack of bag tubes previously positioned in said outfeed station and wherein said movable suction cups support means includes a pivot shaft extending horizontally above said outfeed station, first and second spaced suction cup raising and lowering pneumatic cylinder means having their cylinder ends mounted on said pivot shaft, a transverse support rod attached to the piston rods of said suction cup raising and lowering cylinders, said movable suction cups including first and second suction cups fixedly connected to said transverse support rod and a relatively movable suction cup mounted for vertical movement on said transverse support rod between said two fixedly positioned suction cups, first and second relatively movable pusher plates mounted for vertical movement on said transverse support rod outwardly of said fixedly positioned suction cups, means normally biasing said relatively movable suction cup and pusher plates downwardly to an elevation below the elevation of said fixedly positioned suction cups so that said supported bag tube is positioned in an M-shaped configuration as viewed from the front edge thereof to prevent the lower half of the bag tube from bulging downwardly to open the bag tube.

10. The invention of claim 9 additionally including lift initiating switch means mounted on said transverse support rod responsive to upward movement of said vertically movable suction cup with respect to said transverse support rod for initiating contraction of said suction cup raising and lowering pneumatic cylinders to lift said movable suction cups and pusher cups and said supported bag tube to said elevated position, a swing arm attached to said pivot shaft, a swing cylinder connected on one end to said supporting framework and connected on an opposite end to said swing arm so that actuation of said swing cylinder effects a pivotal movement of said pivot shaft and said suction cup raising and lowering cylinder means to effect swinging movement of said movable suction cups and supported bag tube to said discharge position.

11. The invention of claim 10 additionally including elevation control means for automatically positioning and maintaining the upper end of a stack of bag tubes in said outfeed station within a desired height range of adjusting the elevation of the outfeed end of said bag tube stack conveyor.

12. The invention of claim 10 additionally including a vacuum source, conduit means connecting said vacuum source to said movable suction cups and means responsive to movement of said movable suction cups to said discharge position adjacent said individual bag tube outfeed means for terminating the connecting of said vacuum source to said movable suction cups to permit the release of said supported bag tube from said movable suction cups.

13. The invention of claim 12 additionally including elevation control means for automatically positioning and maintaining the upper end of a stack of bag tubes in said outfeed station within a desired height range of adjusting the elevation of the outfeed end of said bag tube stack conveyor.

14. The invention of claim 13 wherein said bag tube stack conveyor includes a conveyor platform, a plurality of conveyor belts having an upper flight extending along said conveyor platform, pivotal support means supporting said conveyor platform at the infeed end of said conveyor and wherein said elevation control means comprises pneumatic cylinder means connected to the outfeed end of said conveyor for raising and lowering the outfeed end of said conveyor.

15. A bag tube feeding means comprising a supporting framework, a bag tube stack conveyor having an outfeed end defining an individual bag tube outfeed station and an infeed end for receiving and supporting a plurality of stacks of bag tubes, drive motor means for said bag tube stack conveyor, a plurality of movable suction cups, movable suction cup support means supporting said movable suction cups for movement above said outfeed station, individual bag tube outfeed means adjacent said outfeed station for receiving individual bag tubes from said movable suction cups and removing said individual bag tubes to a desired discharge point, control means for said movable suction cups for sequentially lowering said movable suction cups to engage the uppermost bag tube of a stack of bag tubes in said outfeed station, lifting said movable suction cups and a supported bag tube supported thereby to an elevated position and swinging said movable suction cups and said supported bag tube to a discharge position in which said supported bag tube is adjacent said individual bag tube outfeed means to be received thereby, conveyor control means for activating said drive motor means for said bag tube stack conveyor to feed a next adjacent stack of bag tubes to said outfeed station in immediate response to the depletion of a stack of bag tubes previously positioned in said outfeed station, hold-down suction cup means mounted on said bag tube stack conveyor to engage and hold the lowermost bag tube in said outfeed position and elevation control means for automatically positioning and maintaining the upper end of a stack of bag tubes in said outfeed station within a desired height range by elevating the outfeed end of the stack of bag tubes in the outfeed station moving below said desired height range.

16. A bag tube feeding means comprising a supporting framework, a bag tube stack conveyor having an outfeed end defining an individual bag tube outfeed station and an infeed end for receiving and supporting a plurality of stacks of bag tubes, drive motor means for said bag tube stack conveyor, a plurality of movable suction cups, movable suction cup support means supporting said movable suction cups for movement above said outfeed station, individual bag tube outfeed means adjacent said outfeed station for receiving individual bag tubes from said movable suction cups and removing said individual bag tubes to a desired discharge points, control means for said movable suction cups for sequentially lowering said movable suction cups to engage the uppermost bag tube of a stack of bag tubes in said outfeed station, lifting said movable suction cups and a supported bag tube supported thereby to an elevated position and swinging said movable suction cups and said supported bag tube to a discharge position in which said supported bag tube is adjacent said individual bag tube outfeed means to be received thereby, conveyor control means for activating said drive motor means for said bag tube stack conveyor to feed a next adjacent stack of bag tubes to said outfeed station in immediate response to the depletion of a stack of bag tubes previously positioned in said outfeed station, hold-down suction cup means mounted on said bag tube stack conveyor to engage and hold the lowermost bag tube in said outfeed position, a vacuum source, conduit means connecting said vacuum source to said movable suction cups and said hold-down suction cup and means responsive to movement of said movable suction cups to said discharge position adjacent said individual bag tube outfeed means for terminating the connection of said vacuum source to said movable suction cups to permit the release of said supported bag tube from said movable suction cups and wherein said bag tube stack conveyor includes a conveyor platform, a plurality of conveyor belts having an upper flight extending along said conveyor platform, pivotal support means supporting said conveyor platform at the infeed end of said conveyor and said elevation control means comprises pneumatic cylinder means connected to the outfeed end of said conveyor for raising and lowering the outfeed end of said conveyor.

17. A bag tube feeding means comprising a supporting framework, bag tube stack supporting means defining an individual bag tube outfeed station, suction cup support means positioned above said bag tube outfeed station, a plurality of suction cups mounted on said suction cup support means, a vacuum source connected to said suction cups, individual bag tube outfeed means mounted on said framework adjacent said outfeed station for receiving individual bag tubes from said suction cups and conveying said individual bag tubes to a desired discharge point, control means for said suction cup support means for sequentially lowering said support means and said suction cups to a lower position to engage the uppermost bag tube of a stack of bag tubes in said outfeed station and lifting said movable suction cups along with the uppermost bag tube from said stack to an elevated position, pivot means supporting said suction cup support means and suction cups for swinging movement from said elevated position to a discharge position in which said supported bag tube is engaged by said individual bag tube outfeed means to be received thereby, swing control means for effecting said swinging movement to said discharge position including horizontal pivot means supporting a swing initiate microswitch means adjacent said elevated position for movement between a normal horizontal position and a canted position, a movable actuator on said microswitch means positioned to be engaged by an upper surface on said suction cup support means when said suction cup support means is moved from its lower position to its elevated position to activate said swing initiate microswitch, power means responsive to closure of said swing initiate switch for swinging said suction cup support means from said elevated position to said discharge position and means for swinging said suction cup support means to said elevated position from said discharge position wherein said horizontal pivot means is positioned above said movable actuator and said swing intitiate microswitch is in its normal horizontal position and said movable actuator is engaged by a side surface of said suction cup support means to pivot said swing initiate microswitch to its canted position without actuating said microswitch upon return of said suction cup support means from said discharge position to said elevated position.

18. The invention of claim 17 wherein said pivot means supporting said suction cup support means and suction cups includes a pivot shaft extending horizontally above said outfeed station, said control means includes first and second spaced suction cup raising and lowering pneumatic cylinder means having their cylinder ends mounted on said pivot shaft, a transverse support rod attached to the piston rods of said suction cup raising and lowering cylinders, said suction cups including first and second suction cups fixedly connected to said transverse support rod at spaced locations along the length of said transverse support rod and a relatively movable suction cup mounted for vertical movement on said transverse support rod between said two fixedly positioned suction cups, means normally biasing said relatively movable suction cup downwardly to an elevation below the elevation of said fixedly positioned suction cups so that extension of said suction cup raising and lowering pneumatic cylinders results in engagement of said vertically movable suction cup with the uppermost bag tube in said outfeed station prior to engagement of said fixedly positioned suction cups with said uppermost bag tube to cause said relatively movable suction cup to move upwardly with respect to said transverse support rod and lift initiating switch means responsive to said upward movement of said vertically movable suction cup for initiating contraction of said suction cup raising and lowering pneumatic cylinders to lift said suction cups and said supported bag tube to said elevated position and said swing control means includes a swing arm attached to said pivot shaft, a swing cylinder connected on one end to said supporting framework and connected on an opposite end to said swing arm so that actuation of said swing cylinder effects a pivotal movement of said shaft and said suction cup raising and lowering cylinder means to effect swinging movement of said movable suction cups to said discharge position.

19. The invention of claim 18 additionally including elevation control means for automatically positioning and maintaining the upper end of a stack of bag tubes in said outfeed station within a desired height range by adjusting the elevation of the bag tube stack supporting means.

20. The invention of claim 18 additionally including spring biased pusher plates mounted on said transverse support shaft outwardly of said suction cups in alignment with said relatively movable suction cup.

21. The invention of claim 17 additionally including vacuum breaker means responsive to movement of said movable suction cups to said discharge position adjacent said individual bag tube outfeed means for terminating the connection of said vacuum source to said movable suction cups to effect the release of said supported bag tube from said movable suction cups.

22. The invention of claim 21 wherein said vacuum breaker includes a rigid valve body defining a hollow chamber, an opening in said valve body, a reed valve overlying said opening, conduit means connecting said chamber to said vacuum source, additional conduit means connecting said chamber to said suction cups and pusher means connected to said swing arm for engaging said reed valve to move said reed valve from said overlying relation to said opening to vent said chamber to atomsphere when said suction cups are moved to said discharge position.

* * * * *